US005368414A

United States Patent [19]

Miller

[11] Patent Number: 5,368,414

[45] Date of Patent: Nov. 29, 1994

[54] METHOD AND SYSTEM FOR REHABILITATING A BULKHEAD

[76] Inventor: Vincent G. Miller, 235 Benson Pl., Westfield, N.J. 07090

[21] Appl. No.: 732,787

[22] Filed: Jul. 19, 1991

[51] Int. Cl.[5] ..... E02D 29/02

[52] U.S. Cl. ..... 405/262; 405/258; 405/284

[58] Field of Search ..... 405/262, 259.1, 284, 405/285, 286, 287, 287.1, 258, 272, 273

[56] References Cited

U.S. PATENT DOCUMENTS 1,947,151 2/1934 Caples .
2,018,423 10/1935 Smith ..... 405/262
3,226,930 1/1966 White .
3,229,468 1/1966 Schneller ..... 405/285 X
3,236,054 2/1966 Northrop .
4,110,990 9/1978 Thompson et al. .
4,189,891 2/1980 Johnson et al. ..... 405/284 X
4,480,945 11/1984 Schnabel .
4,561,804 12/1985 Weatherby ..... 405/262
4,674,921 6/1987 Berger ..... 405/284 X
4,728,225 3/1988 Brandl et al. ..... 405/285 X
4,911,582 3/1990 Pierce, Jr. et al. .
4,917,543 4/1990 Cole et al. .

*Primary Examiner*—Dennis L. Taylor
*Attorney, Agent, or Firm*—Curtis, Morris & Safford

[57] ABSTRACT

The invention relates to a method and system for rehabilitation of an existing retaining wall or bulkhead.

25 Claims, 4 Drawing Sheets

METHOD AND SYSTEM FOR REHABILITATING A BULKHEAD

FIELD OF THE INVENTION

The invention relates to earth retaining walls or "bulkheads". More particularly, the invention relates to a method and system for rehabilitation of an existing retaining wall or bulkhead. The reasons for rehabilitation can include actual or threatened corrosion, impending structural failure, or enlargement of a wharf or pier proximate the existing bulkhead.

As used herein, "outboard" means on the side of a pre-existing bulkhead wall opposite the deadman. "Inland" means on the same side of a pre-existing bulkhead wall as the deadman. "Deadman" and "soil anchor" mean any counterweight or support located in or on the ground. "Tie back/wale system" means a support system including wale, tie rod, and deadman. "Tie rod" means any elongate member that functions to transfer lateral load between a wale or pre-existing bulkhead wall and a deadman.

BACKGROUND OF THE INVENTION

Anchored earth retaining walls or "bulkheads" are a typical method of supporting earth and dividing land from water to create wharf age.

Bulkhead designs vary, but in general consist of a wall member constructed of materials such as wood, metal, or concrete driven or inserted into the ground. At times, the bulkhead stands alone and does not need any additional buttressing. For example, in marine applications, where the water is fairly shallow and the wall fairly short, driving the bottom edge of the wall to a sufficient depth below the ground surface provides enough support for the wall that it is able to function without reinforcement. However, frequently, it is necessary to provide support for the wall additional to that resulting from the wall's implantation in the ground, such as (referring now to the preceding example) when the water is deep or the wall is high.

The usual method of providing additional support utilizes a tie rod connected at one of its ends to the wall, and at its other end to a deadman or "ground anchor". An alternative technique is to secure one end of one or more tie rods to the bulkhead wall and fix the other end of each tie rod in the ground. The tie rods are oriented such that they slope downwardly from the location of attachment to the bulkhead wall to the location of fixation in the ground.

In typical conventional configurations, the bulkhead is supported laterally by a wale and a tie back system which transmits the lateral earth load from the wall to a deadman located at some distance behind the face of the bulkhead.

All bulkhead walls undergo deterioration over time. This is especially the case with steel sheet pile walls. Additionally, there can be numerous other reasons for replacing, repairing, modifying, or reinforcing such walls.

Wall replacement is not a desirable option because it entails partial or complete demolition of the existing wall and disruption of traffic and other functions in the general area behind the existing wall during installation of the replacement wall. Nevertheless, comprehensive rebuilding of bulkheads is often necessary when deterioration of the wall member is substantial.

In lieu of comprehensive rebuilding, the usual "fix" has consisted of driving sheeting outboard of the existing sheeting, excavating inland of the original steel wall, and installing new tie rods attached to the new sheeting. To secure the new sheeting or wall with tie rods, the ground inland of the original wall must be removed. The tie rods must then be attached to the new wall and/or to an anchor located at a relatively large distance from the wall. This is followed by backfilling inland of the original steel wall, and filling the space between the new sheeting and old wall.

The repair technique described in the preceding paragraph is both time consuming and expensive. Since the tie rod and deadman are installed prior to backfilling, the expensive technique of working from a barge or trestle may be required. A further disadvantage is that backfilling over and around a tendon or tie rod may result in flexure and tensioning of the tie rod, thereby increasing the chance of tie rod failure. Another disadvantage is that temporary support of the new bulkhead during testing of the tie rods is usually required. And, it is a major shortcoming that this technique does not utilize the existing bulkhead, including the functional tie back/wale system.

U.S. Pat. No. 4,728,225 to Brandl et al. discloses a bulkhead rehabilitation method akin to the foregoing technique, wherein new tie rods are installed in addition to new sheeting.

Another bulkhead rehabilitation technique is disclosed in U.S. Pat. No. 4,480,945 to Schnabel. New tie rods are installed, running from the original bulkhead under rehabilitation to a location inboard of the bulkhead, with accompanying expense and difficulty. A sufficient number of tie rods are installed so that all additional required support is provided by the new tie rods. The technique disclosed in the '945 patent does not appear to make use of a new bulkhead wall.

The art would be advanced by provision of an alternative to the foregoing which is more conveniently and efficiently implemented.

OBJECTS OF THE INVENTION

It is an object of this invention to provide an advantageous method and system for rehabilitating an existing bulkhead, the tie back/wale combination of which is structurally sound.

It is another object of this invention to provide a method and system of rehabilitating a deteriorated bulkhead by incorporating the existing bulkhead into a new structural system.

It is still another object of this invention to provide a method and system of rehabilitating a deteriorated bulkhead utilizing the existing tie rod, wale and deadman for support.

It is yet another object of this invention to provide a method and system of rehabilitating a deteriorating bulkhead involving transferring at least a substantial part of the lateral load developed in a replacement bulkhead wall to the existing deadman.

SUMMARY OF THE INVENTION

The present invention is directed to a method and system of rehabilitating an existing bulkhead. More specifically, the invention provides a novel method and system for rehabilitating a bulkhead, the existing tie back/wale system for which structure is functional (or can be rendered functional without replacement or other repair requiring excavation behind the original wall of the bulkhead). For purposes of the present invention, the term "bulkhead" shall include any earth-retaining structure supported by a tie back/wale system. The invention is especially well-suited for use with such structures adapted for use in a marine environment.

In one aspect, the invention is a method for rehabilitating a bulkhead including a pre-existing wall member supported by a deadman connected to the pre-existing wall member by a tie rod, which method comprises the steps of: locating a new wall member outboard of the pre-existing wall member; and attaching the new wall member to the pre-existing wall member via a connecting member such that at least a substantial part of the lateral load developed in the new wall member is transferred to the existing deadman through the existing tie back/wale system (this includes embodiments in which the entire lateral load, i.e., the maximum design load is so transferred).

In another aspect, the invention is a bulkhead system which comprises a first wall member supported by a deadman connected to said wall member by a tie rod; a second wall member located outboard of the first wall member; and means for transferring at least a substantial part of the lateral load developed in said second wall member to the deadman through the tie rod.

The present invention is highly advantageous because its practice is less time consuming, less expensive, and more effective than the technique of inserting a new bulkhead wall in front of an existing bulkhead wall and attaching the new wall to new tie rods and/or a new deadman. A principal benefit is that the present invention can be practiced without removing earth behind the pre-existing bulkhead wall. Because the invention makes it unnecessary to install new tie rods or deadmen, it obviates the need for new support hardware behind of both the new and pre-existing wall members, thereby saving substantial cost, effort, and time.

DESCRIPTION OF CERTAIN PREFERRED EMBODIMENTS

This invention is particularly applicable to bulkheads for the separation of land from water, but can be applied to rehabilitation of any earth retaining wall containing a tie back/wale system.

A central feature of the present invention is the positioning of a rehabilitating wall member outboard of the pre-existing wall member with the rehabilitating wall deriving support from the support structure of the pre-existing bulkhead. This eliminates the need for installation of a new support system, with the benefits discussed in preceding paragraphs. Advantageously, the new wall is implanted in the ground, adjacent the pre-existing wall, to a vertical depth such that the new wale is substantially adjacent the pre-existing wale on the pre-existing wall. This system is believed to result in effective transfer of lateral load through the connecting beam back to a pre-existing deadman, thereby to provide maximum support for the new wall member. The system is typically designed such that it can transfer the full load of lateral earth pressure back to the pre-existing deadman, ground anchor or the like, even though one or more other components of the system may bear some of the load, since the cost of the load transfer assembly is not very sensitive to the load assumption and thus design for the original full load will not overly burden the system from a cost standpoint.

Figure 1:
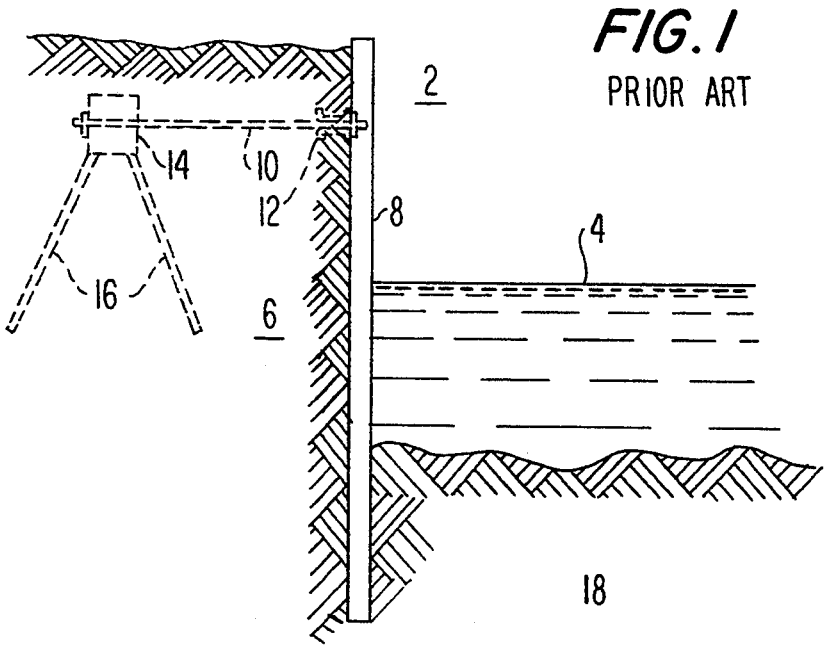
FIG. 1 PRIOR ART
FIG. 1 is a schematic vertical sectional view of a conventional bulkhead.

FIG. 1 illustrates a common type of bulkhead 2 which divides a body of water 4 from land 6. Bulkhead 2 includes generally vertical facing or piling 8 which is formed of a material such as concrete, steel, or wood. The bottom edge of piling 8 is driven or inserted into the ground 18. Additional support for the wall is furnished by a tie rod 10 connected at one of its ends to wall member 8 through a wale 12 and at its other end to a deadman 14. Support piles 16 may also be attached to deadman 14 to provide further support.

Figure 2:
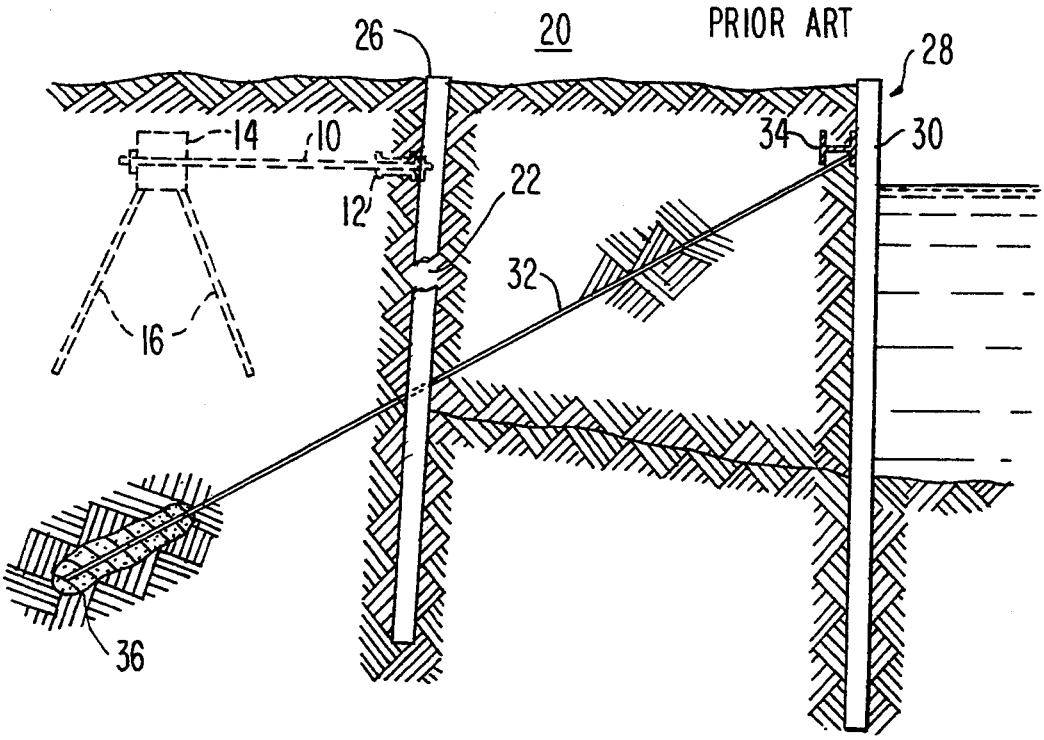
FIG 2 PRIOR ART
FIG. 2 is a schematic vertical sectional view of a conventional technique for reinforcing an existing bulkhead, as illustrated in FIG. 1, by the installation of a new bulkhead wall.

For purposes of contrast with the present invention, FIG. 2 illustrates a typical system 20 for bulkhead rehabilitation. Rehabilitation is required because of a failure or break 22 in pre-existing wall 26. New bulkhead 28 is installed at a predetermined distance from original bulkhead 26 on the water-side. Bulkhead 28 includes wall member 30 which is driven or inserted into the channel bottom to provide the toe for lower end support of bulkhead 28. Support at the upper end of bulkhead 28 is provided by a tie rod 32 which is attached to a wale 34 adjacent to the upper end of wall member 30. Tie rod 32 extends toward the land-side at an angle below the horizontal through the original bulkhead 26 and to a new grouted anchor or deadman 36 in the ground behind such original bulkhead.

Figure 3:
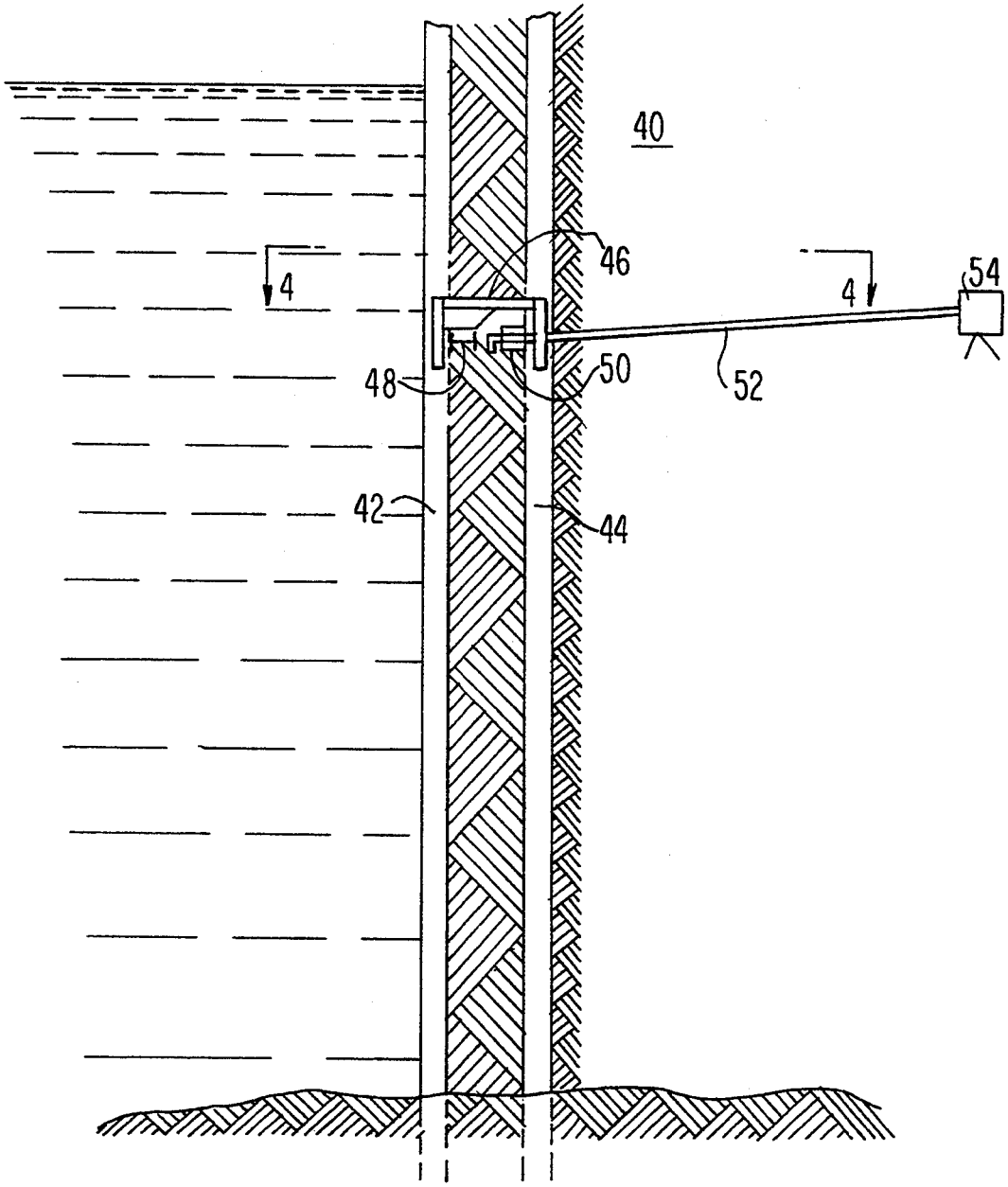
FIG. 3 is a cross-sectional schematic view of a bulkhead reinforced in accordance with the invention.
Figure 4:
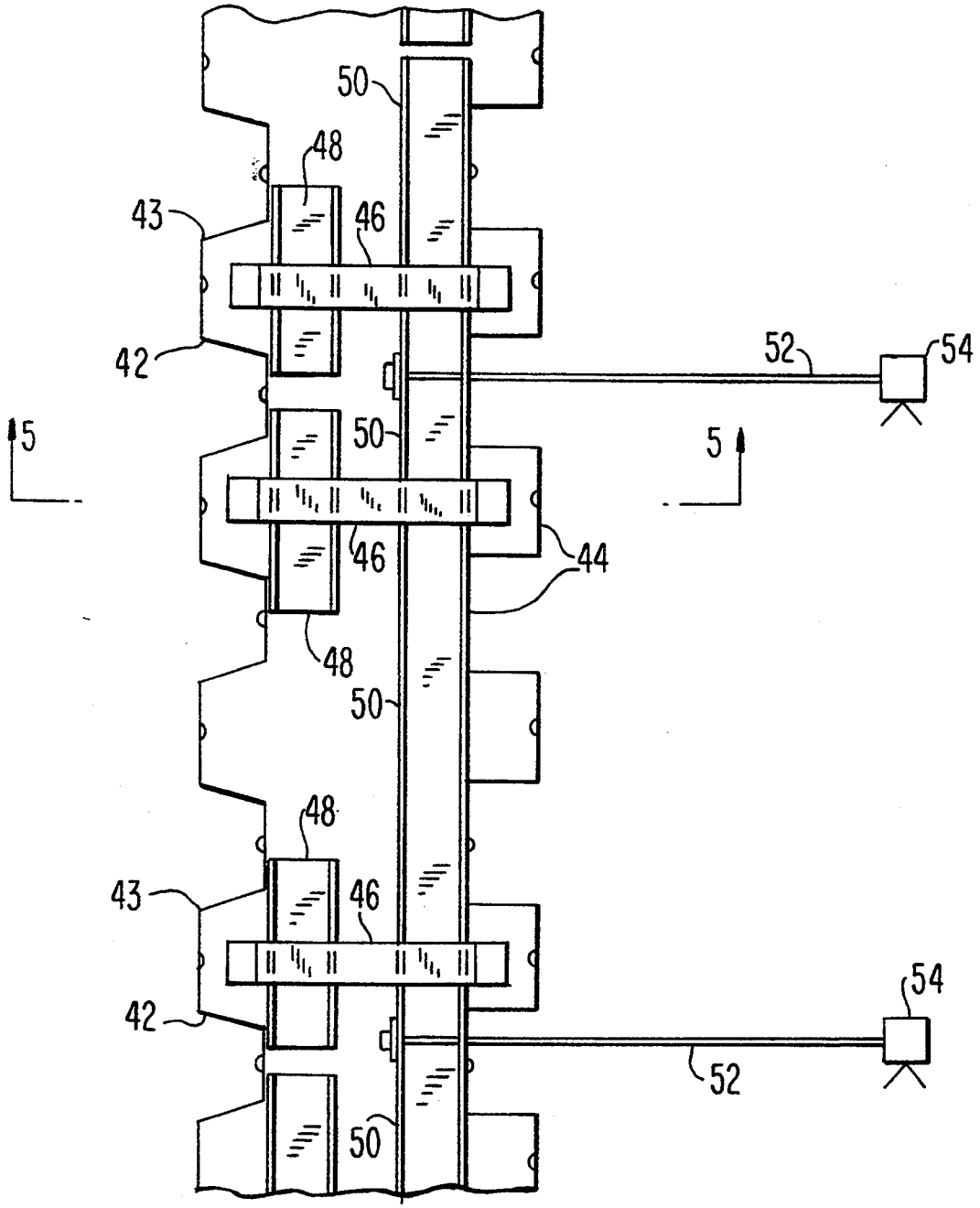
FIG. 4 is a cross-sectional view, along line A—A, of the bulkhead construction depicted in FIG. 3.
Figure 5:
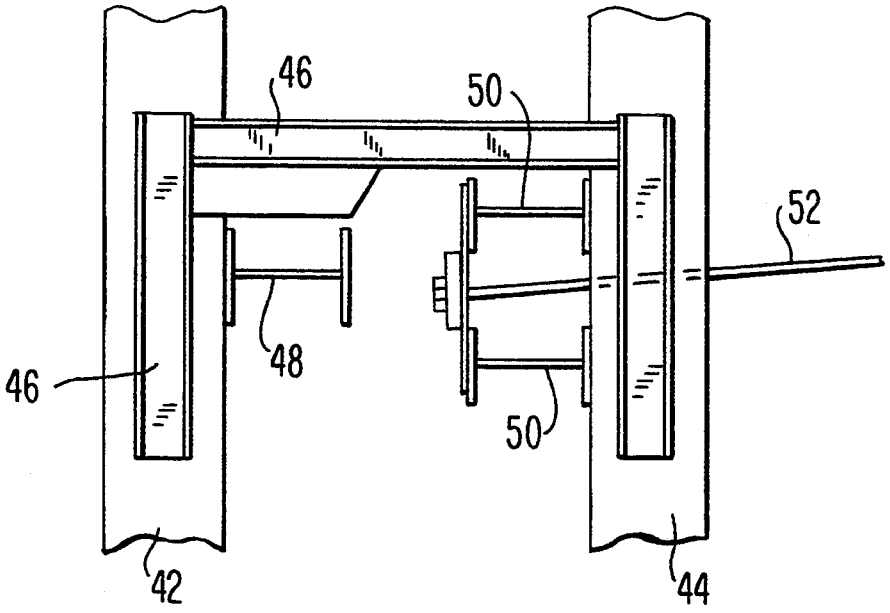
FIG. 5 is a cross-sectional view, along line B—B, of a wale and tie rod arrangement from the bulkhead depicted in FIG. 4.

FIGS. 3 through 5 depict different views of a bulkhead 40 reinforced in accordance with the present invention. New wall member 42 is attached to pre-existing wall member 44 via inverted U-shaped connecting member 46. The connecting member is attached to both new wale 48 secured to wall member 42, and pre-existing wale 50 secured to wall member 44. Pre-existing wall member 44 is secured by pre-existing tie rod 52 attached at one end to wale 50 and at the other end to a deadman or soil anchor 54. Lateral load developed in new wall member 42 is transferred through connected member 46 back to the pre-existing wale and pre-existing tie rod, and via that structure back to pre-existing deadman or grouted anchor 54. The components of the system can be joined to one another by bolting or welding, and the joining mechanism (in certain embodiments) includes structural members (e.g., plates or bars), provided that the structural requirements for load, shear and bending stress are met.

In a preferred embodiment of the invention, a wale is secured to the upper portion of a new wall member which is located adjacent the pre-existing wall member. Said wale can be attached by any of the various methods known in the art, typically by welding or bolting.

Wall member 42 can be implemented by known methods, such as impact driving or vibratory driving. Conventional soil mechanics analysis can be utilized to determine lateral earth loads acting upon the wall, and the length of sheeting imbedded in the ground. In some embodiments, silo pressures developing between the walls, and some contribution of the deteriorated or pre-existing sheeting is taken into account. The geometry of the pre-existing wall or sheeting in some cases determines the design of the rehabilitating wall.

Sound construction practice and physical sizing will dictate the minimum horizontal distance between the new and pre-existing wall members. In certain good embodiments of the invention, the new wall member approximately three feet or more from the pre-existing wall members. The maximum horizontal distance between the new and pre-existing wall members should be determined by such variables as permitting requirements, costs, and size of the wall members. An appropriate spacing between the two walls varies from one situation to another, depending on the particular circumstances, and can be derived empirically. One of ordinary skill in the art will be able, once in possession of the teachings herein, to determine this without an undue amount of experimentation.

New wall member 42 is substantially planar and may, without limitation, be constructed of wood pilings, steel sheeting, corrugated steel sheeting, pre-cast concrete, or a combination of these materials. In marine applications, corrugated steel sheeting is preferred because the corrugated shape exhibits economics in design and cost when compared to other shapes, and because of the deterioration problem that marine borer and limnoria infestation may raise for wall members constructed of wood pilings. Whatever its specific composition or configuration, it is preferred that wall member 42 be capable of withstanding at a minimum, the stresses to which wall member 44 was subjected.

New wale 48 can be attached to new wall member 42 before or after positioning said new wall member. The simplest and least expensive method is to do so prior to positioning.

In a preferred embodiment, adjacent new wall members 42 and 43 are positioned in pairs in a substantially planar vertical arrangement. This permits efficient rehabilitation of larger areas of deteriorated bulkhead wall.

Next, connecting member 46 is positioned in a substantially inverted position between wales 48 and 50. Connecting member 46 is a pre-fabricated structural force transfer member comprising steel or a material of similar strength and durability. An inverted U-shaped arrangement is preferred, but any structural member or combination of members capable of transferring lateral load developed in new wall member 42 to the pre-existing deadman 54 through pre-existing wale 50 and pre-existing tie rod 52 is within the scope of the invention. For example, in some embodiments "C" or "L" shaped members can be used depending upon the geometry and angular relationship of the wall members to which they are to be attached.

The gap between wall members 42 and 44 is filled with an effective amount of filler material sufficient to secure connecting member 46 in place and substantially inhibit movement of wall member 42 relative to wall member 44. Suitable filler materials include sand, stone, concrete, and mixtures of such materials. Factors which influence the selection of filler material(s) are, for instance, cost, ease of placement, quality control of the product, lateral loading and corrosion protection.

In a preferred embodiment, the lower portion of the gap between wall members 42 and 44 is filled with material such as crushed stone or sand up to a level within several feet of the U-shaped member. The immediate environment of the U-shaped member and wales 48 and 50 is then filled with a tremie concrete or equivalent. The upper remainder of the gap between wall members 42 and 44 is filled with material such as crushed stone or sand.

Wales 48 and 50 may be constructed in any manner known in the art, and of any material of sufficient strength to withstand the stress resulting from the lateral load. Steel is the preferred material because of its strength and relative cost efficiency.

What is claimed is:

1. A method for rehabilitating a bulkhead including a pre-existing wall member supported by a pre-existing tie rod connected to means for anchoring that pre-existing wall member, which method comprises the steps of:

locating a new wall member outboard of the pre-existing wall member; and connecting the new wall member to said pre-existing wall member via a connecting member such that at least a substantial part of the lateral load developed in said new wall member is transferred to the anchoring means through the tie rod and such that the new wall member is supported without installation of a new tie rod between the pre-existing wall members and the anchoring means.

2. A method as defined in claim 1, wherein a first wale is mounted on said pre-existing wall member, which comprises connecting said new wall member to said pre-existing wall member by attaching a connecting member to said first wale and to a second wale mounted on said new wall member.

3. A method as defined in claim 2, which comprises connecting said new wall member to said pre-existing wall member by attaching one end of a connecting member, which has end portions and a portion bridging said end portions to the first wale and another end portion to said second wale.

4. A method as defined in claim 1, which comprises connecting said new wall member to said pre-existing wall member via a connecting member which is substantially "U"-shaped.

5. A method for rehabilitating a bulkhead including a pre-existing wall member supported by means for anchoring said wall member, a first wale being mounted on said wall member and said anchor means being connected to said first wall member by a pre-existing tie rod, which method consists essentially of the steps of:

locating a new wall member, having a second wale mounted thereon, outboard of the pre-existing wall member such that there is a gap between said pre-existing and new wall members;

connecting the new wall member to said pre-existing wall member via a connecting member by attaching one portion of the connecting member to said first wale and attaching another portion of said connecting member to said second wale, such that at least a substantial part of the lateral load developed in said new wall member is transferred to said anchor means through the tie rod, and such that the new wall member is supported without installation of a new tie rod between the pre-existing wall member and the anchoring means; and depositing filler material in said gap.

6. A method as defined in claim 5, which comprises filling said gap with filler material which includes concrete.

7. A method as defined in claim 5, which comprises filling said gap with filler material which includes stone.

8. A method as defined in claim 5, which comprises filling said gap with filler material which includes sand.

9. A method as defined in claim 4, which comprises the step of filling the gap with multiple layers of material, including a layer of tremie concrete contacting said connecting member.

10. A method as defined in claim 1 wherein said new wall member is corrugated in configuration.

11. A method for rehabilitating a bulkhead including a pre-existing wall member having mounted thereon a first wale, said wall member supported by an anchoring means, said anchoring means being connected to said pre-existing wall member by a tie rod, which method consists essentially of the steps of:

implanting in the ground a new wall member of corrugated configuration, having a second wale mounted thereon, at a location outboard of said pre-existing wall member, such that there is a gap between said pre-existing and new wall members;

connecting the new wall member to said pre-existing wall member via a connecting member by attaching one end portion of the connecting member to said first wale and attaching the other end portion of said connecting member to said second wale, such that at least a substantial part of the lateral load developed in said new wall member is transferred to said anchor means through the tie rod, and such that the new wall member is supported without installation of a new tie rod between the pre-existing wall member and the anchoring means; and depositing filler material in said gap.

12. A method as defined in claim 11, which comprises connecting the wall members via a connecting member that has end portions bridged by a curved portion.

13. A method as defined in claim 11, which comprises depositing concrete in said gap.

14. A bulkhead system, which consists essentially of:

a first and pre-existing wall member supported by a deadman connected to said wall member by a pre-existing tie rod;

a second wall member located outboard of the first wall member;

means for transferring at least a substantial part of a lateral load developed in said second wall member to the deadman through the pre-existing tie rod; and wherein a first wale is mounted on said first wall member and a second wale is mounted on said second wall member, and a connecting member attached to said first and second wales connects said second wall member to said first wall member.

15. A system as defined in claim 14, wherein said connecting member has a pair of end portions and a portion bridging said end portions, one of said connecting member's end portions being attached to the second wale and the other end portion being attached to said first wale to connect said second wall member and said first wall member.

16. A system as defined in claim 14, wherein said second wall member is connected to said first wall member via a connecting member which is substantially "U"-shaped.

17. A rehabilitated bulkhead system consisting essentially of:

a pre-existing wall member supported by means for anchoring said wall member, said anchoring means connected to said pre-existing wall member by a pre-existing tie rod, said pre-existing wall member further having a first wale mounted thereon outboard of said wall member;

a rehabilitating wall member, having a second wale mounted thereon, located outboard of the pre-existing wall member such that said pre-existing and rehabilitating wall members are spaced apart;

a connecting member, one portion of which is attached to said first wale and another portion of which is attached to said second wale thereby to connect the pre-existing wall member and the rehabilitating wall member, such that at least a substantial part of a lateral load developed in said rehabilitating wall member is transferred to said anchor means through the pre-existing tie rod; and filler material deposited between said pre-existing and rehabilitating wall members.

18. A system as defined in claim 17, wherein said filler material includes concrete.

19. A method as defined in claim 17, wherein said filler material includes stone.

20. A system as defined in claim 17, wherein said filler material includes sand.

21. A system as defined in claim 16, wherein said filler material includes multiple layers, each layer having a constitution different than each adjacent layer, including a layer of tremie concrete contacting said connecting member.

22. A system as defined in claim 17, wherein said rehabilitating wall member is corrugated in configuration.

23. A rehabilitated bulkhead system consisting essentially of:

a pre-existing wall member having mounted thereon a first wale, said wall member supported by means for anchoring it, said anchor means connected to said pre-existing wall member by a pre-existing tie rod;

a rehabilitating wall member of corrugated configuration, having a second wale mounted thereon, implanted at a predetermined depth in the ground at a location outboard of said pre-existing wall member, such that said pre-existing and rehabilitating wall members are spaced apart;

a connecting member, one end portion of which is attached to said first wale and the other end portion of which is attached to said second wale thereby to connect said rehabilitating wall member and said pre-existing wall member, such that at least a substantial part of a lateral load developed in said rehabilitating wall member is transferred to said anchor means through the pre-existing tie rod; and filler material deposited between said pre-existing and rehabilitating wall members.

24. A system as defined in claim 23, wherein the connecting member is configured to have end portions and a curved portion bridging the end portions.

25. A system as defined in claim 23, wherein said filler material includes concrete.

* * * * *

UNITED STATES PATENT AND TRADEMARK OFFICE

CERTIFICATE OF CORRECTION

PATENT NO. : 5,368,414

DATED : November 29, 1994

INVENTOR(S) : Vincent G. Miller and Vladimir Ostrov

It is certified that error appears in the above-identified patent and that said Letters Patent is hereby corrected as shown below:

On the title page, item 76, after "Vincent G. Miller, 235 Benson Pl., Westfield, N.J. 07090" please insert, —and Vladimir Ostrov, 98-33 64th Avenue, Apt, 5G, Rego Park, N.Y. 11374—.

Signed and Sealed this

Twenty-eight Day of March, 1995

*Attest:*

Bruce Lehman

BRUCE LEHMAN

*Attesting Officer*

*Commissioner of Patents and Trademarks*